US007275881B2

(12) United States Patent
Block et al.

(10) Patent No.: US 7,275,881 B2
(45) Date of Patent: Oct. 2, 2007

(54) CONTROL OF DUAL PRINTING MECHANISMS

(75) Inventors: David Block, El Cerrito, CA (US); James Craig, Newtown, CT (US); Patrick R. Reitz, Danbury, CT (US)

(73) Assignee: Sanford, L.P., Freeport, IL (US)

( * ) Notice: Subject to any disclaimer, the term of this patent is extended or adjusted under 35 U.S.C. 154(b) by 293 days.

(21) Appl. No.: 10/964,920

(22) Filed: Oct. 15, 2004

(65) Prior Publication Data

US 2006/0083572 A1 Apr. 20, 2006

(51) Int. Cl.
*B41J 1/50* (2006.01)

(52) U.S. Cl. ..... 400/149; 400/150

(58) Field of Classification Search ..... 400/149, 400/150

See application file for complete search history.

(56) References Cited

U.S. PATENT DOCUMENTS 4,776,711 A * 10/1988 Harada ..... 400/24
5,911,527 A * 6/1999 Aruga et al. ..... 400/149
6,030,133 A * 2/2000 Endo ..... 400/82
6,168,324 B1 * 1/2001 Lever et al. ..... 400/82
6,607,316 B1 * 8/2003 Petteruti et al. ..... 400/82
6,938,969 B2 * 9/2005 Shibasaki ..... 347/12

FOREIGN PATENT DOCUMENTS

EP 0 834 828 4/1996
WO 2004/114257 12/2004

* cited by examiner

*Primary Examiner*—Minh Chau
(74) *Attorney, Agent, or Firm*—Marshall, Gerstein & Borun LLP

(57) ABSTRACT

A printing system comprising: a printing device having first and second similar printing mechanisms; first and second similar holding means for holding respective first and second rolls of label stock in a position to pass the first and second printing mechanisms respectively; and a local processor connected to supply print data to a selected one of said first and second printing mechanisms and comprising means for receiving print data and a command for supplying said print data to the selected one of said first and second printing mechanisms to print an image on a label of the respective associated one of said first and second rolls of label stock, based on said command; and a host computer connected to the printing system and arranged to execute a common printer driver for supplying said print data and command to the printing device, regardless of which printing mechanism is selected.

5 Claims, 3 Drawing Sheets

CONTROL OF DUAL PRINTING MECHANISMS

The present invention relates to control of dual printing mechanisms, particularly in the context of printing labels. The invention has particular but not exclusive applicability in the field of printers which print images onto die cut labels which are secured to a backing material by removable adhesive, and formed into a roll. Such rolls of label stock are known in the art, and a product which uses such label rolls is currently available under the trade name LabelWriter.

In the LabelWriter printer, a roll of label stock is rotatably mounted in the printer and a feed mechanism advances the stock past a printing mechanism which prints a user defined image onto each label. Labels can then be removed from the backing carrier. The LabelWriter printer is connected to a host computer in use, where a user can define the image to be printed.

The LabelWriter printer is used for a number of different applications, for which different types of label stock apply. Each type of label stock has for example different shape or different size labels secured to the backing carrier. It is often the case that any particular user may wish to use the LabelWriter for more than one application on a repeated basis. For example, they may have an ongoing need for both shipping labels and postage labels, or for address labels and file folder labels. At the moment, it is necessary for a user to change the label stock in the LabelWriter each time they wish to change their application. This means that a user is constantly having to switch between rolls of label stock, which is awkward and time consuming.

EP-A-834828 describes a hybrid printer which has a plurality of independent printing mechanisms each having its own printhead and being adapted to print on a respective one of a plurality of types of recording medium. The hybrid printer is connected to a host device for receiving print data and dispatching status information. In this hybrid printer, the printing mechanisms are all different because the idea is to provide a facility for printing different types of documents by one printer.

Each print mechanism therefore requires its own print d river for generating print data in a manner acceptable to that printing mechanism.

It is one aim of the present invention to provide a printing device which allows easy access to different label types without a user having to change rolls.

According to one aspect of the present invention there is provided a printing system comprising: a printing device having first and second similar printing mechanisms; first and second similar holding means for holding respective first and second rolls of label stock in a position to pass the first and second printing mechanisms respectively; and a local processor connected to supply print data to a selected one of said first and second printing mechanisms and comprising means for receiving print data and a command for supplying said print data to the selected one of said first and second printing mechanisms to print an image on a label of the respective associated one of said first and second rolls of label stock, based on said command; and a host computer connected to the printing system and arranged to execute a common printer driver for supplying said print data and command to the printing device, regardless of which printing mechanism is selected.

A common printer driver executed at the host computer connected to the printing device is arranged to supply said print data and, in one embodiment, a selection command which determines which of the first and second printing mechanisms is to be used.

The above mentioned aim is satisfied where the first and second rolls of label stock are of differing types. Thus, based on the selection made by a user at a host device attached to the printer, the local processor can determine to which of the printing mechanisms the print data is to be supplied. As the first and second printing mechanisms are essentially the same, only a single printer driver is needed, which is arranged to generate a control code to be read by the local processor for determining whether to print on the first or second roll.

It is possible to use the printing device defined above to hold first and second rolls of label stock which are identical. In this case, the printing device can be set up to automatically switch from an expired roll of label stock to the other roll of label stock. In that case, the problem that can arise is that a roll of label stock can include undesirable partial labels at its end. This arises from the label manufacturing process. During the manufacture of label stock, the length of the label stock that has passed through a manufacturing machine is the determining parameter for the ending point of one roll and the beginning point of the subsequent roll. The positional accuracy of the manufacturing equipment is such that the demarcation point between label rolls is random and has no positional relationship to the die cut label on the continuous label carrier. Therefore for any particular roll of label stock there is a reasonable probability that the last label of a previously unused roll will be a partial label.

This means that the last label printed on an about to expire roll may not be a complete label. In the described embodiment of the present invention, this problem is solved as defined below. For the sake of completeness it is pointed out that the same manufacturing process can lead to partial labels at the beginning of a new roll. A solution to this problem is provided by PCT/IB04/002194 in the name of Dymo Corporation.

Another aspect of the invention provides a method of controlling a printing device to print a label comprising: receiving information from a user including print data defining an image to be printed and a command identifying an automatic mode for printing mechanism selection; supplying said print data and said command to a printing device for printing said labels, said printing device having first and second rolls of label stock and associated first and second printing mechanisms; storing print data defining each label in a label buffer as that print data is supplied for printing; overwriting each stored print data by print data for a subsequent label until a reprint request indicator is received; and on receipt of said reprint request, re-supplying the last stored print data to the printing device.

A further aspect provides a computer program product which implements this method when loaded into a computer.

Another aspect of the invention provides a method of printing a label comprising: receiving print data defining an image to be printed and a command identifying an automatic mode; supplying said print data to a first roll of label stock associated with the first printing mechanism; monitoring the status of the first roll of label stock; and, when it is detected that the first roll of label stock has expired, issuing a reprint request to recall already printed data and supplying said printed data to a second roll of label stock with an associated second printing mechanism, whereby the last label of the first roll is reprinted as the first label of the second roll.

Another aspect of the invention provides a printing device comprising: first and second similar printing mechanisms;

first and second similar holding means for holding respective first and second rolls of label stock in a position to pass the first and second printing mechanisms respectively; and a local processor connected to receive print data defining an image to be printed and a command identifying an automatic mode, to supply said print data to the first roll of label stock and, when it is detected that the first roll of label stock has expired, to issue a reprint request for already printed data and to supply said already printed data to the second roll of label stock, whereby the last label of the first roll is reprinted as the first label of the second roll.

It will be appreciated that the above aspects of the invention can also be applied to a printing device which has a single holding means for a single roll of label stock. That is, the invention provides in another aspect a method of printing a label comprising: receiving print data defining an image to be printed; supplying said print data to a printing mechanism for printing on a first roll of label stock; monitoring the status of the first roll of label stock; and, when it is detected that the first roll of label stock has expired and has been replaced by a subsequent roll of label stock issuing a reprint request to recall already supplied print data and supplying said data to the printing mechanism for printing on the subsequent roll of label stock whereby the last label of the first roll is reprinted as the first label of the subsequent roll.

A further aspect of the invention provides a printing device comprising: a printing mechanism; holding means for holding a roll of label stock in a position to pass the printing mechanism; a local processor connected to receive print data defining an image to be printed and to supply said print data to the printing mechanism for printing on a first roll of label stock in the holding means; and means for detecting that the first roll of label stock has expired and has been replaced by a subsequent roll; wherein the local processor is operable to issue a reprint request for already supplied print data and to supply said data to the subsequent roll of label stock, whereby the last label of the first roll is reprinted as the first label of the subsequent roll.

That is, when printing to a single roll, the reprint mechanism will work when the roll is reloaded based on a reprint request. The reprint request can be issued based on a reprint request indicator whose status is set in the status buffer. The reprint request indicator can be a specific indicator, or can be a printer empty bit which is set as soon as the first roll expires. When the subsequent roll is reloaded, the print empty bit is cleared and a reprint request is issued.

For a better understanding of the present invention and to show how the same may be carried into effect, reference will now be made by way of example to the accompanying drawings, in which.

The following described printing system has two similar print mechanisms and one print driver. The choice of which roll it is printing on is made based either on the printer firmware switching automatically when a roll becomes empty, or based on control codes that tell the printer to print on the left or right roll.

Figure 1:
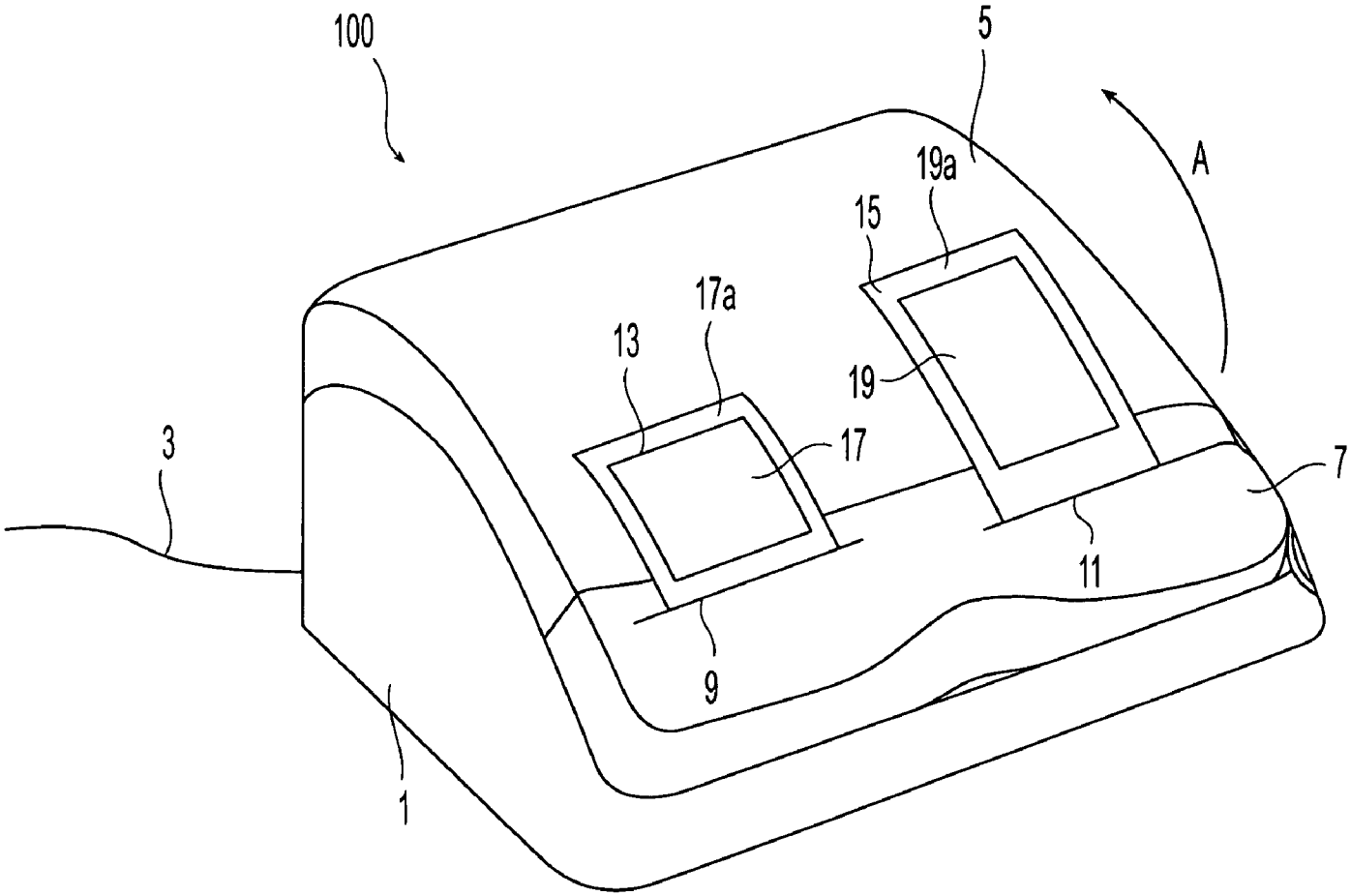
FIG. 1 shows the external casing of a printing device in accordance with one embodiment of the invention.

FIG. 1 shows the external casing of a printing device in accordance with one embodiment of the invention. The printing device has a base 1 which is connected to a cable 3 which allows the printing device to be connected to a host computer. The device has a lid 5 which can be opened in the direction of arrow A and a lower cover part 7. The lower cover part includes first and second slots 9, 11 through which can be seen to protrude the ends of first and second rolls of label stock 13, 15. Each roll of label stock 13, 15 is mounted on a holder which cannot be seen in FIG. 1 because of the lid 5, but which allows the label stock to be advanced from the holder through the respective slot 9, 11. The holders are substantially the same and are mounted on a common axial line through the printer. Advancing of label stock is under the control of one or more feed motors. First and second printing mechanisms sit below the lower cover part 7 (similarly concealed in FIG. 1) and perform printing operations on the labels as they are fed past the printing mechanism. In FIG. 1, the label stock 13 carries a plurality of labels 17 of a first type, secured to a back carrier or web 17*a* by an adhesive in a manner known per se. The label stock 15 carries a plurality of labels 19 of a second type similarly secured to a backing carrier 19*a* by releasable adhesive.

It will be appreciated that the rolls of label stock and their holders are substantially identical, apart from the type of labels carried by each label stock.

Figure 2:
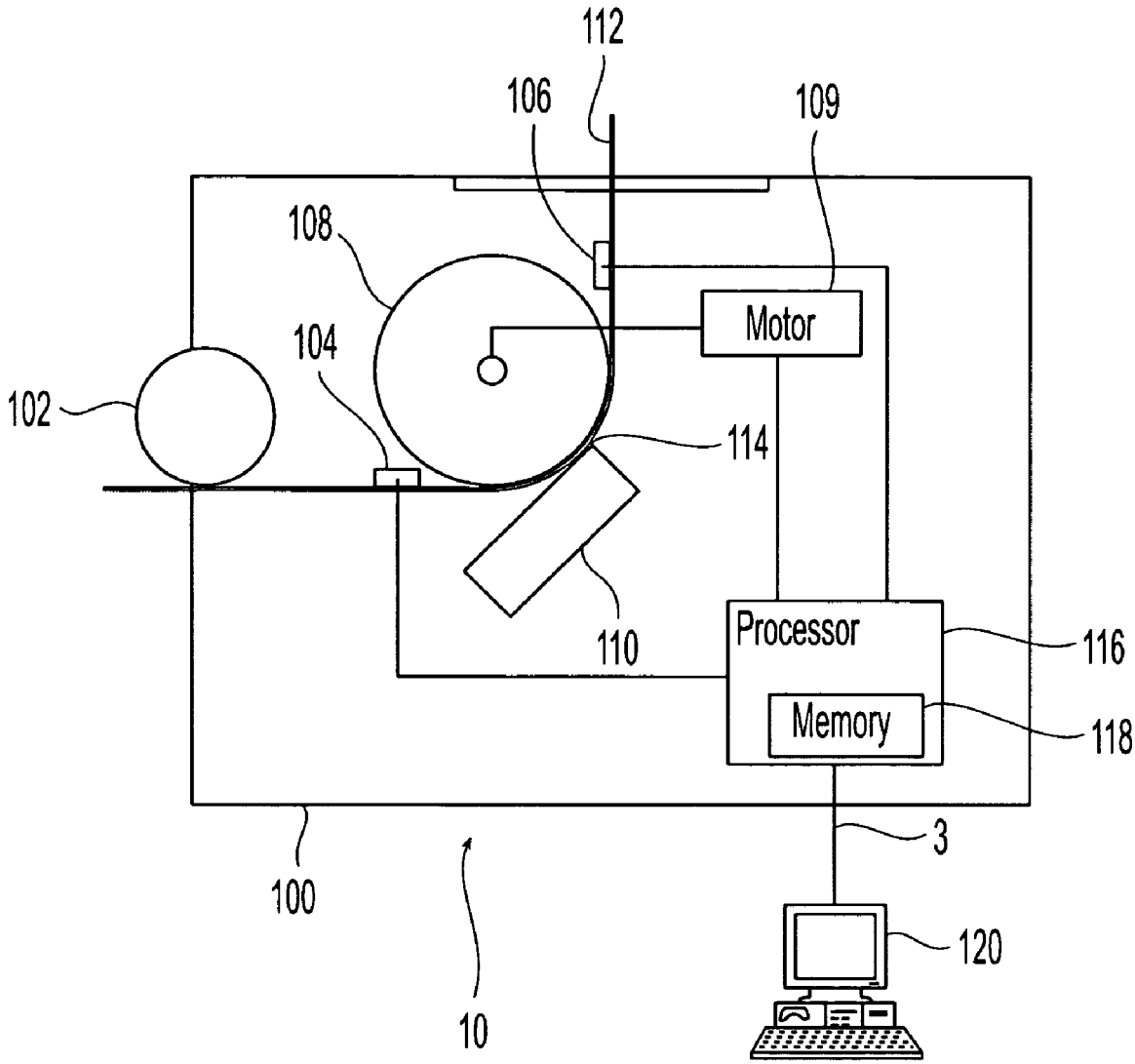
FIG. 2 shows a schematic block diagram of important components for the printing device.

FIG. 2 is a schematic diagram of the important components of the printing device of FIG. 1. In FIG. 2, only a single label roll with its associated motor and printing mechanism is illustrated. It will be readily apparent however that the arrangement is the same for the second label roll in the printing device, with components being shared as described in the following. The printing device 10 includes a label printer 100 connected to a computer system 120. The label printer 100 accepts label stock mounted on a holder 102 and prints information onto labels of the label stock 13.

The label printer 100 includes a top of form (TOF) sensor 104, a label size indicator (LSI) sensor 106, a platen 108, a motor 109, a printhead 110, an exit point 112 (corresponding to the slots 9, 11 in FIG. 1) and a processor 116. The processor 116 includes memory 118 for storing information, including data that the printer 100 collects.

Although not shown in FIG. 2, the label printer 100 includes a second similar holder 102 of label stock 13, TOF sensor 104, label size indicator sensor 106, platen 108, motor 109, printhead 110 and exit point 112 for the second supply of label stock. It will be appreciated however that the processor 116 and memory 118 is shared.

Each TOF sensor 104 detects TOF marks and the presence or absence of label stock 102. One important function of the TOF sensor 104 is to determine when a roll of label stock has expired, that is when the last label of the label stock has been utilised. The LSI sensor 106 detects LSI marks and the presence or absence of label stock 102. Each motor 109 drives its associated platen 108 such that the platen 108 turns in a clockwise or counter-clockwise direction. Rotation of the platen 108 causes the label stock 102 to advance in a forward direction if the platen 108 rotates counter-clockwise, or to advance in a reverse direction if the platen 108 rotates clockwise. Each printhead 110 prints information onto the labels of its associated label stock 17. Each printhead 110 is positioned such that the information is printed at a pinch point 114 of the platen and its associated printhead 110.

The computer system 120 sends print requests to the label printer 100, in a form to be discussed later. Of particular note however is the fact that the computer system 120 executes a common printer driver for both printheads, and sends with print data a command which allows the processor 116 to determine which printhead is to be utilised. The commands are discussed in more detail hereinafter. The computer system 120 can also send status requests to the label printer 100. The label printer 100 sends information to the computer system 120 describing the types of labels contained on each roll of label stock, whether or not the label printer 100 is ready to print and the like. The label printer 100 also returns status reports. This information allows the computer system 120 to format print requests to the label printer 100.

Figure 3:
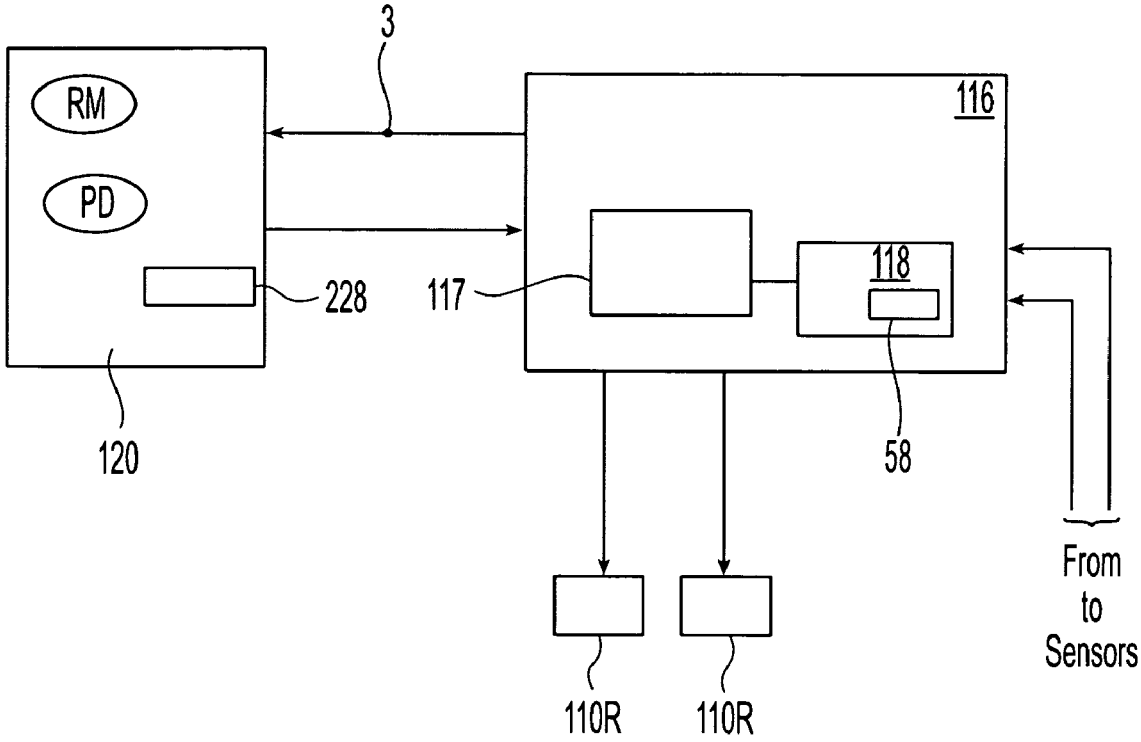
FIG. 3 shows a schematic block diagram of the control components of the printing device and host computer.

FIG. 3 is a schematic diagram illustrating important components of the control mechanism for the label printer 100 and host computer 120. The processor 116 is illustrated connected to the computer system 120 via a bidirectional link 3. The host computer 120 executes a number of processes to allow a user to control printing in a manner known per se. Two of the processes have been altered however and are described in more detail in the following. They are illustrated by circles labelled PD for the printer driver and RM for a reprint monitor. It will readily be appreciated that this use of circles is schematic only, and that in fact the processor executes code from the memory in a manner which is known per se.

The processor 116 receives feedback from the TOF and LSI sensors 104, 106 which allow the processor 116 to determine the status of each of the first and second printing mechanisms. These status values are held in a status buffer SB which forms part of the memory 118 so that they can be accessed by the computer system 120 by a request status command dispatched from the computer system 120 to the local processor 116. Each status held in the status buffer comprises a plurality of bits to denote different types of status elements. Of importance in the present case are the paper empty bit (PEB) and the reprint request bit (RRB). These are shown in the Status Report of FIG. 4.

The print driver PD receives input from a user defining labels to be printed and generates print data which is supplied to the local processor 116 to drive one of the printheads to print an image onto a label. For ease of reference, the printheads in FIG. 3 are labelled 110L (denoting the print mechanism for the left roll) and 110R (denoting the print mechanism for the right roll). The printer driver PD presents a user interface at the computer system 120 which allows a user to select between the left or right roll, and responsive to this selection the computer system 120 dispatches with the print data a command over the bidirectional cable 3 which is read by control logic 117 and causes it to drive the correct one of the printheads. This command is termed herein the selection command. At a display on the computer system 120 a user is presented with two paper trays named left roll and right roll. Once a user has made a selection, the printer driver adds the roll selection command to the start of each print job.

The selection command is useful where the label rolls are of differing types representing different types of label for a user.

Another command which is available which is useful in a situation where the label rolls are of the same type is the "automatic mode" command. When this command has been instigated by a user at the user interface of the computer system 120, it is dispatched to the local processor 116 and read by the control logic 117. It causes the printer to automatically switch to the other roll if the current roll is empty. To support this command, the reprint monitor RM is utilised. It is used to forward data to the printer for printing. When in the automatic mode, the reprint monitor avoids loss of labels during printing. The printer will detect an out of paper condition using the TOF sensor. This condition is detected by the control logic 117 and is used to alter the printing mechanism which is being utilised so that subsequent print data is supplied to the other printing mechanism. That is, when the first roll expires, the printer automatically switches to the second roll. When the second roll expires, the printer switches back to the first roll if a new roll has been loaded, otherwise it maintains the PEB until the roll has been replaced.

For the reasons discussed earlier, a problem arises in that the last label printed on the now empty roll may not be a complete label. If the print process simply continues printing on the next roll, assuming that the previous label was printed successfully, if the last label on the roll was not a full label, the label will be lost. To prevent lost labels, the reprint monitor allows the printer to reprint the last label as the first label on the next roll. Immediately after the need to switch is determined, the Reprint Request Bit (RRB) will be set causing the next status request by the host to result in a reply with the RRB set. While this may lead to unnecessary double printing of labels in some cases, it guarantees that no labels are lost.

Figure 4:
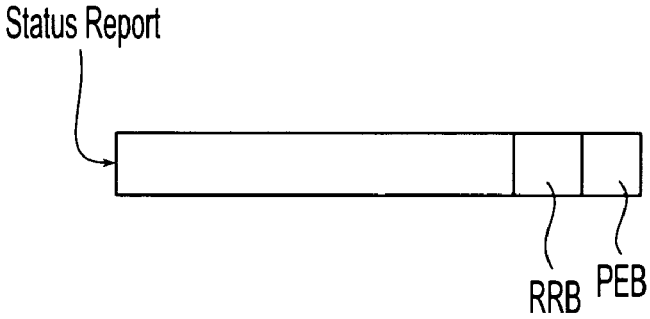
FIG. 4 shows a status report.

To allow the reprint monitor RM to operate correctly, the status report shown in FIG. 4 includes the reprint request bit RRB. This bit is set by the control logic 117 when it has switched over from one roll to another following the above-described process. The status report, including the RRB and PEB is return to the host computer 120 in response to a status request therefrom, so that these bits can be used to determine what data to dispatch to the printer.

The method of operation of the reprint monitor to achieve the above result will now be described.

The reprint monitor will parse/assemble the data it receives into whole labels. When it completes sending a label to the printer, it places it in an internal "Last Label Buffer" LLB. This buffer is key to the process that follows.

Note that error handling differs from existing hybrid printers. With the printing device described above, the printer status can report:

1) An error condition in the printer, but will not distinguish between which print mechanism is in error, only that there is an error.

2) A paper empty condition that has two possible conditions:

a) If the printer is set to automatically switch to the other roll when one becomes empty (automatic mode), then this condition is only reported when both rolls are empty.

b) When a print job is being sent to only one roll, the paper empty condition is reported when the selected roll is empty. At this point, there can be no further printing to either roll until the first one is reloaded or the print job is cancelled and the printer reset.

Since the printer empty condition prevents further printing to either mechanism/roll until rectified by a reload or reset of the print job, the printer cannot continue printing on one mechanism if another printing mechanism is in error. Moreover, there is only one status report returned by the printer and it combines the status of both mechanisms.

The reprint request bit (RRB) is set every time the printer switches from one roll to another due to the paper tray being set to Automatic, and the "current" roll becoming empty. The bit will be cleared by the next data it receives.

The handling of each call to the reprint monitor is as follows:

```
Repeat
    Request Printer Status
Until for Status = TOF or Status = RRP or Status = Paper Empty or
    Status = Other Error
; the above is to make sure the printer has had time to detect an
end of paper
;after the last block of data was sent to printer
If RRP = TRUE then
    Resend data from Last Label Buffer
Else If Status - Paper Empty (or other error) then
    Display a dialog telling user of error
    Monitor status until error cleared
    Hide dialog
    Resend data from Last Label Buffer
Else
    Send next Label
    Move label to Last Label Buffer
End
```

It will be appreciated that the reprint monitor is implemented on code sequence executable by the host computer to implement the above steps each time it is called.

The print empty bit PEB can be used to provide a similar effect in a single roll printer. That is, in a single roll printer when a first roll has expired and a subsequent roll has been reloaded, the print empty bit can be used to cause a reprint of the last label. That is, the print empty bit is set in the status report when the first roll expires. Note that in this embodiment there is no need for the RRB. When the print empty bit is cleared by a user successfully reloading a subsequent roll of label stock, a reprint request is issued from the local processor to the host and the host resends data for the last label. Thus, the last label can be reprinted as the first label of the subsequent roll.

The invention claimed is:

1. A printing system comprising:

a printing device having first and second similar printing mechanisms;

first and second similar holding means for holding respective first and second rolls of label stock in a position to pass the first and second printing mechanisms respectively; and a local processor connected to supply print data to a selected one of said first and second printing mechanisms and comprising means for receiving print data and a command for supplying said print data to the selected one of said first and second printing mechanisms to print an image on a label of the respective associated one of said first and second rolls of label stock, based on said command; and a host computer connected to the printing system and arranged to execute a common printer driver for supplying said print data and command to the printing device, regardless of which printing mechanism is selected; and wherein the local processor is arranged to read an automatic code in the command received with said print data, and is configured on receipt of said automatic code to direct print data to the second printing mechanism when the first roll of label stock has expired.

2. A printing system according to claim 1, wherein the printing device comprises a memory holding a status report representing the status of the printing device.

3. A printing system according to claim 2, wherein said status report includes a printer empty indication which is set, if the selection code has been read, in the ease that the selected one of the first and second rolls is expired and, if the automatic code has been read when the second roll of label stock is expired, if the first roll has already expired and not been reloaded.

4. A printing system according to claim 1, wherein the status report holds a reprint request indicator which causes a last label printed on the first roll to be reprinted as the first label of the second roll, if the automatic cod has been read.

5. A printing system according to claim 1, wherein the host computer is arranged to execute a reprint monitor which organizes print data into complete labels and holds a last label to be printed so that such a last label can be reprinted in response to receipt of a set reprint request indicator.

* * * * *